US005466179A

United States Patent [19]

Jeffrey, Sr.

[11] Patent Number: 5,466,179

[45] Date of Patent: Nov. 14, 1995

[54] SELF INFLATABLE FLOTATION DEVICE

[76] Inventor: Lawrence W. Jeffrey, Sr., 842 E. Alosta, #18, Glendora, Calif. 91740

[21] Appl. No.: 172,021

[22] Filed: Dec. 21, 1993

[51] Int. Cl.[6] ..... B63C 9/08

[52] U.S. Cl. ..... 441/108; 441/94; 441/123

[58] Field of Search ..... 441/94, 106, 108, 441/80, 88, 113, 123, 117

[56] References Cited

U.S. PATENT DOCUMENTS

| | | | |
|---|---|---|---|
| Re. 31,305 | 7/1983 | Moran | 441/118 |
| 1,069,691 | 8/1913 | Hansen | 441/113 |
| 2,823,396 | 2/1958 | Erickson | 441/117 |
| 4,379,705 | 4/1983 | Saotome | 441/108 |
| 4,842,562 | 6/1989 | Supal | 441/94 |
| 5,022,879 | 6/1991 | DiForte | 441/108 |
| 5,095,957 | 3/1992 | Herman | 441/117 |

*Primary Examiner*—Stephen Avila
*Attorney, Agent, or Firm*—Poms, Smith, Lande & Rose

[57] ABSTRACT

A self inflating flotation device comprising a pouch adapted to be worn about the waist of a user until needed. The device includes an inflatable chamber therein. A compressed air cylinder is coupled to a one-way valve in fluid communication with the interior of the chamber for quickly and easily inflating the chamber.

1 Claim, 3 Drawing Sheets

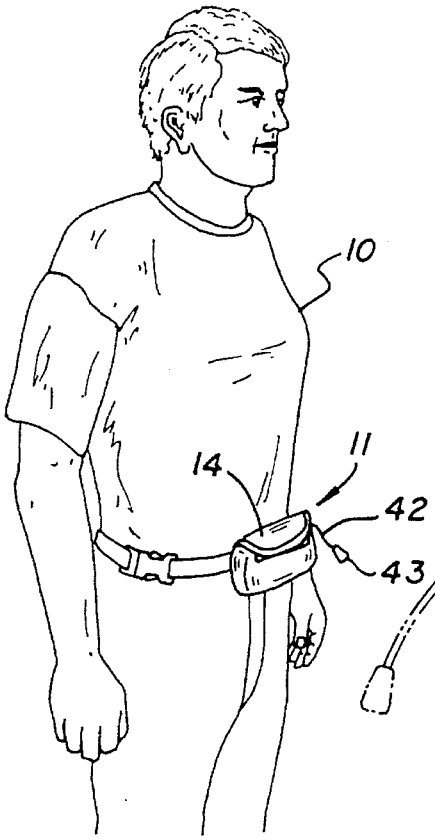
FIG. 1
FIG. 2
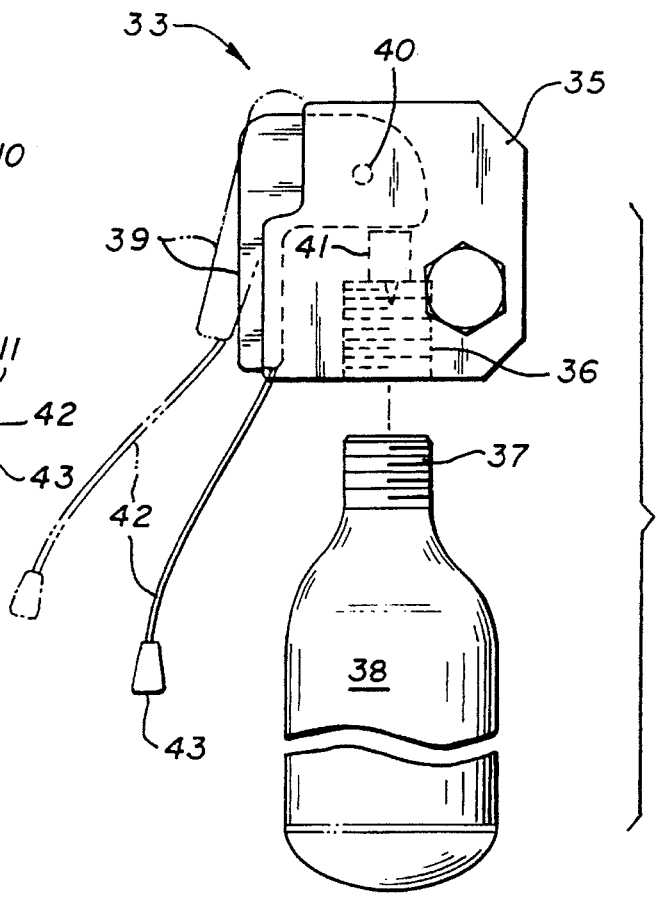
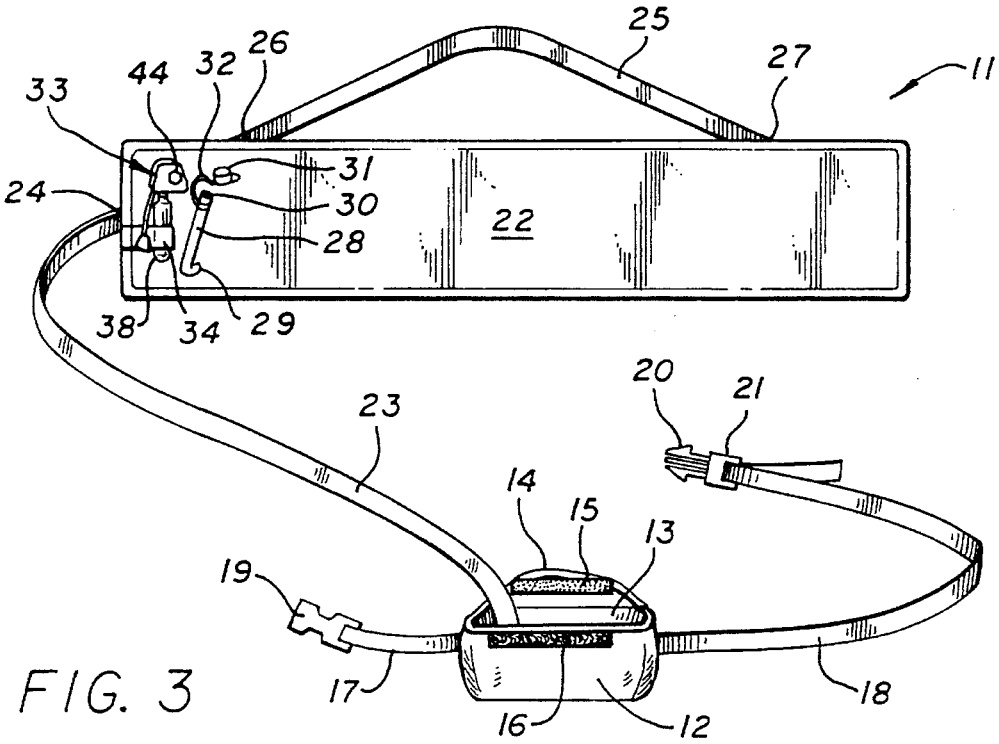
FIG. 3

SELF INFLATABLE FLOTATION DEVICE

BACKGROUND OF THE INVENTION k

1. Field of the Invention

The invention relates to flotation devices; and, more particularly, to a self inflating flotation device adapted to be worn about the chest of a user when inflated with a stretchable band.

2. Description of the Prior Art

Many devices are known in the art for use in the water for providing buoyancy to a user. Some devices must be inflated by one's breath or by an external pump. Some devices are bulky and not easily carried by a person prior to the need for the same. Such devices, being bulky, cannot easily be worn while swimming above water or under water without interfering with the swimmer's normal activities.

There is a need for a self inflating floatable device which can be worn about the waist of a user, does not interfere with the user's normal activities such as swimming on top of water, under water, diving from diving board, skin diving, etc. and can be automatically inflated from the storage pouch.

SUMMARY OF THE INVENTION

It is an object of this invention to provide an improved self inflating flotation device.

It is a further object of this invention to provide a self inflating flotation device which can be worn about the waist of a user until needed. Then automatically inflated from the storage pouch.

It is another object of this invention to carry out the foregoing object without need for an external pump or using one's breath.

These and other objects are preferably accomplished by providing a self inflating flotation device comprising a pouch adapted to be worn about the waist of a user until needed. The device includes an inflatable chamber therein. A compressed air cylinder is coupled to a one-way valve in fluid communication with the interior of the chamber for quick and easily inflating the chamber.

The device can thus be used under water prior to inflation allowing the swimmer to swim normally. Multiple air chambers interconnected by suitable valves may be used.

BRIEF DESCRIPTION OF THE DRAWING

FIG. 1 is a perspective view of a user having the flotation device of the invention carrying on the waist of the user;

FIG. 2 is an exploded view of a portion of the device of FIG. 1;

FIG. 3 is a perspective view of the flotation device alone of FIG. 2 prior to inflation with portions thereof shown out of the storage pouch;

DESCRIPTION OF THE PREFERRED EMBODIMENTS

Figure 4:
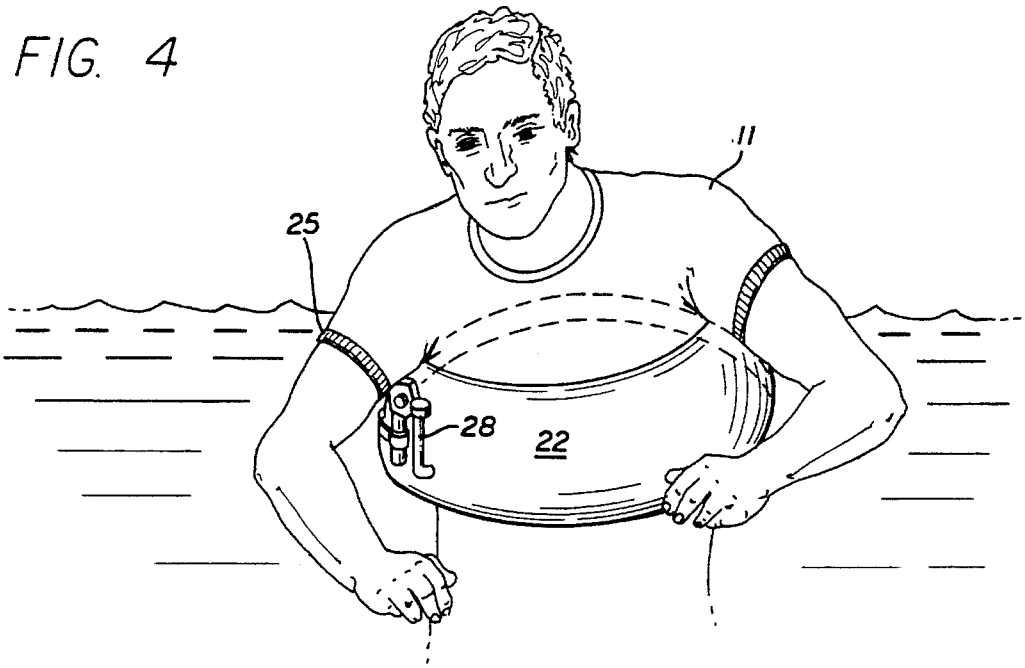
FIG. 4 is a perspective view of a swimmer wearing the device of FIGS. 1 and 3 showing the latter in its inflated state.

Referring now to FIG. 1 of the drawing, a user 10 is shown having a flotation device 11 worn his waist.

Device 11 is shown in FIG. 3 and includes a storage pouch 12 having a hollow interior 13 and normally closed by a lid or cover 14 (shown in closed position in FIG. 1). Cover 14 may have mating strips 15, 16, respectively, of hook and loop material. As seen in FIG. 1, the strap 23 and parts connected thereto are stored in the pouch 12 prior to actuation.

A first strap portion 17 (FIG. 3) is attached to pouch 12 in any suitable manner, such as by stitching. A second strap portion 18 is also attached to pouch 12 in any suitable manner, such as by stitching (obviously, portions 17, 18 may be one integral piece stitched or otherwise fastened to pouch 12). Each portion 17, 18 terminates in mating buckle portions 19, 20, respectively. Thus, male buckle portion 20 can be quickly and easily snapped into female buckle portion 19, as is well known in the art, and just as quickly released therefrom.

An adjusting member 21 may also be provided on one of the strap portions, such as portion 18, for quickly and easily adjusting the overall length of the portions 17, 18. This allows the portions 17, 18, and pouch 12, to be worn about the waist of the user, as seen in FIG. 1, and adjusted accordingly.

An inflatable chamber (FIG. 3) 22, which may be any suitable configuration, such as rectangular, hollow on its interior and normally sealed off from the atmosphere, is coupled to pouch 12 by an elongated strap 23 having one end extending into the interior of pouch 12 and secured thereto in any suitable manner. The other end 24 extends to chamber 22 and is also secured thereto in any suitable manner, such as by stitching. Chamber 22 may be a life jacket or the like which is normally disposed inside of pouch 12 and ejected when cord 42 is activated, as will be discussed.

A resilient back strap 25 is provided having ends 26, 27 secured at spaced locations to chamber 22 in any suitable manner, such as by stitching. It can be seen in FIG. 4 that back strap 25 is of a length allowing the apparatus 11 to be worn about the back of a user. Also, as can be appreciated by referring to FIGS. 1 and 3, the entire assembly of device 11, except for strap portions 17, 18, buckle portions 19, 20 and adjustment member 21 can be inserted into the interior of pouch 12 and the latter closed off by cover 14 until ready for use.

Referring again to FIG. 3, an elongated one way valved tube 28 is provided having one end 29 in fluid communication with the interior of chamber 22 and a one way valved end 30 normally closed off by a cap 31 coupled to tube 28 by elongated member 32. In this manner, the user can blow through tube 28, after removing cap 31, and quickly and easily inflate chamber 22. The tube 28 can then be capped off via cap 31. This is the inflated state shown in FIG. 4.

However, as particularly contemplated in the present invention, automatic self inflating means 33 is provided associated with chamber 22 for quickly and easily inflating the same. Thus, referring again to FIG. 3, such means 33 includes a loop 34 of material stitched or otherwise sewn to the exterior of chamber 22. Means 33 also includes a valve housing 35 (see FIG. 2) having a threaded hole 36 for receiving therein a like threaded neck 37 of a conventional $CO_2$ cartridge 38. A lever 39 is pivotally mounted to housing 35 at pivot pin 40 having a pin 41 on the interior and integral with lever 39 adapted to pierce $CO_2$ cartridge 38 at neck 37 when cartridge 38 is in the FIG. 3 position and lever 39 is pulled, via cord 42 coupled thereto, by grasping knob 43 and pulling it away from housing 35 thereby moving lever 39 and pin 41 to the dotted line position shown in FIG. 2 thereby piercing cartridge 38.

Referring again to FIG. 3, it can be seen that cartridge 38 is normally retained in loop 34 at one end and threaded to housing 35 at its other end. Bolt 44 extends through housing 35 and couples the same to a hole in fluid communication with the interior of chamber 22. In this manner, pulling cord 42 pierces cartridge 38 and inflates the interior of chamber 22 as seen in FIG. 4 (of course, either cartridge 38 or tube 28 can be used to result in the state of the chamber 22 shown in FIG. 4). Another $CO_2$ cartridge can now be inserted into hole 36.

Although a single buoyant chamber 27 is shown in FIG. 1, a pair of chambers 45, 46 may be provided separately by a common chamber 47. Thus, like numerals in FIG. 5 refer to like parts of the embodiment of FIG. 3. Chamber 47 has spaced side walls 48, 49, each wall having a conventional one-way valve 50, 51, respectively, associated therewith. Thus, each valve 50, 51 communicates at one end with the interior of chamber 47 and the other end with the interior of its respective chamber 45, 46.

The aforementioned automatic self inflating means 33 is now associated with the interior of chamber 47 so that pulling cord 42 allows compressed air from cartridge 38 to enter the interior of chamber 47 and flow, via valves 50, 51, into the interior of chambers 45, 46, as indicated by the arrows.

Also, air tubes 28 may be provided associated with each chamber 45, 46 for manually inflating the same as heretofore discussed with respect to the embodiment of FIG. 3.

Figure 5:
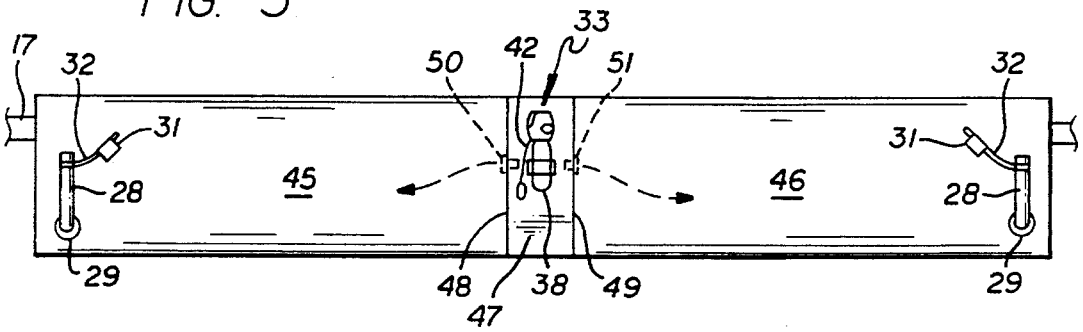
FIG. 5 is an elevational view of a modification of the inflatable chamber of the flotation device of FIGS. 1 to 4.
Figure 6:
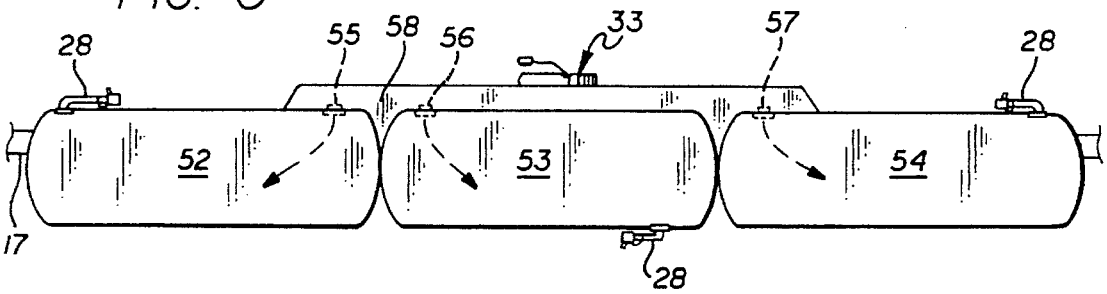
FIG. 6 is an elevational view of a further modification of the inflatable chamber of the flotation device of FIGS. 1 to 4.

Referring now to the embodiment of FIG. 6, where again like numerals refer to like parts of the embodiment of FIGS. 3 and 5, instead of one or two chambers, three chambers 52 to 54 may be provided in fluid communication with a common manifold chamber 58. Self inflating means 33 thus, when operated, injects compressed air into chamber 58 where it flows, via one-way valves 55 through 57, into chambers 52 through 54, respectively. Again, air tubes 28 may be associated with each chamber 52 through 54.

Figure 7:
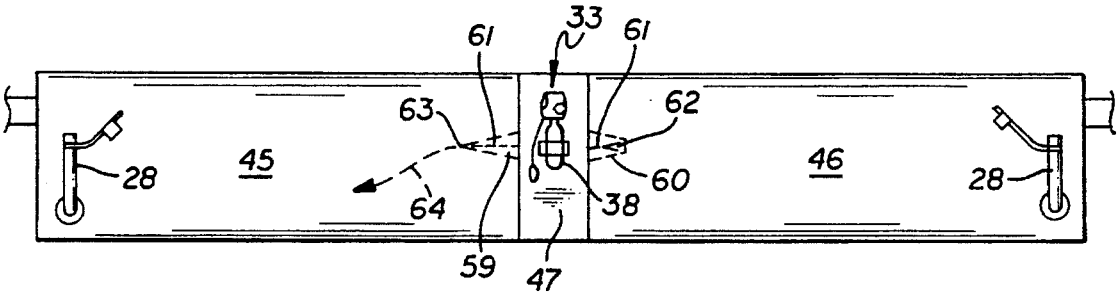
FIG. 7 is a view similar to FIG. 5 showing a modified one-way valve therein.

Referring now to FIG. 7 wherein like numerals refer to like numerals in the embodiment of FIG. 5, one-way valves 50, 51 may be replaced by elongated triangularly shaped valves 59, 60, each being hollow on its interior and of a flexible resilient material. Each valve 59, 60 has a resilient wire 61 (shown in dotted lines) which is normally in a partially folded position as seen at valve 60. When compressed air is injected through valve 60, for example, in its normally folded state, the apex portion 62 unfurls (as seen at valve 59) to allow air to pass out of hole 63 at the apex, as indicated by arrow 64. When all of the compressed air is injected from cartridge 38 into both chambers 45, 46, the air therein stabilizes and apex 62, due to resilient wire 61, returns to the folded position shown at valve 60 closing off hole 63 so no air leaks therethrough.

Figure 8:
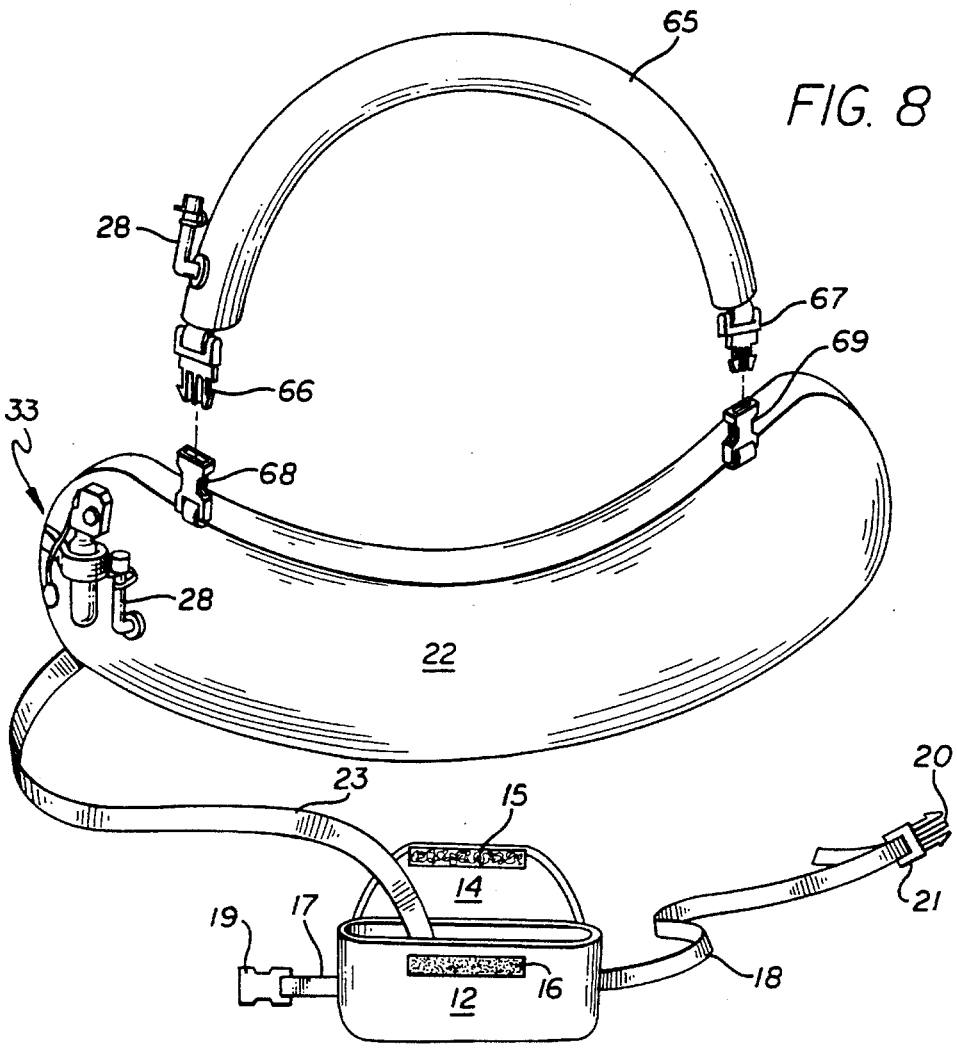
FIG. 8 is another modification of the flotation device of FIGS. 1 to 4.

FIG. 8, wherein like numerals refer to like parts of the embodiment of FIGS. 1 to 4 and 9, an additional tube 65 is provided which goes around the neck of the user. Tube 65 may be inflated manually via a tube 28, identical to the tube 28 of FIG. 3 and its associated parts, and terminates at each end in mating male snap buckle portions 66, 67, respectively. Portions 66, 67 are adapted to snap fit into mating female buckle portions 68, 69, respectively, sewn or otherwise secured at spaced locations on the exterior of chamber 22.

Thus, additional buoyancy is provided using the inflatable neck tube 65. This keeps the user's head up out of the water during use.

In all embodiments, as seen in FIG. 1, cord 42 is pulled and strap 23, and the parts connected thereto, are automatically ejected out of pouch 12 without need for opening the same. The invention is thus quick and easy to use and can be worn by a user in doing other activities until needed. Any suitable materials may be used, such as polyurethane for the material of the chambers. The straps or belts may be of nylon braided material with plastic snap buckles. Pouch 12 may have an inner liner of plastic and an outer nylon or other flexible coating. Velcro material may be used for the hook and loop material. Back strap 25 may be of a stretchable material, if desired. The valves 59, 60 may be of a urethane material.

Although specific embodiments of the invention have been disclosed, other variations of the invention may occur to an artisan and the teachings of the invention are to be limited only by the scope of the appended claims.

I claim:

1. A self inflating flotation device comprising:

a pouch having an inner compartment and a strap connected thereto for wearing the pouch about the waist of a user;

at least one elongated inflatable chamber, said chamber having a strap secured at one end to said pouch, and automatic self inflating means coupled to said chamber in fluid communication therewith for automatically inflating the same, said chamber, when in its uninflated state, and said automatic self inflating means, being receivable in the interior of said pouch; a pair of chambers, each of said pair of chambers being in fluid communication with a manifold chamber, said automatic self inflating means being in fluid communication with said manifold chamber, and a pair of one-way valves, one of said valves being in fluid communication at one end with said manifold chamber and at the other end with one of said pair of chambers, the other of said valves being in fluid communication at one end with said manifold chamber and at the other end with the other of said pair of chambers, each of said valves comprising a triangularly shaped chamber having an apex extending into the interior of its respective chamber with a hole therein, and a resilient member extending along the longitudinal axis thereof normally retaining said triangularly shaped chamber in a position wherein said apex is folded about itself closing off said hole therein whereby, when air passes through each of said valves from said manifold chamber, said folded apex opens to allow air to pass through said pair of chambers, said apex returning to its normal folded position when air in said chambers stabilizes.

* * * * *